United States Patent [19]

Davidson

[11] 4,103,519

[45] Aug. 1, 1978

[54] APPARATUS FOR ULTRASONIC CLEANING OF CARPET, UPHOLSTERY, AND SIMILAR MATERIALS

[75] Inventor: Amber Charles Davidson, Salt Lake City, Utah

[73] Assignee: Byron W. Boyd, Orem, Utah

[21] Appl. No.: 779,189

[22] Filed: Mar. 18, 1977

[51] Int. Cl.[2] ..... D06F 19/00; B08B 3/12

[52] U.S. Cl. ..... 68/3 SS; 8/158; 15/320; 68/18 F; 134/1; 134/109; 134/184

[58] Field of Search ..... 134/1, 10, 13, 21, 184, 134/109; 15/320, 321; 259/DIG. 44; 68/3 SS, 18 F; 8/158

[56] References Cited

U.S. PATENT DOCUMENTS

| | | | |
|---|---|---|---|
| 3,139,101 | 6/1964 | Wyczalek et al. | 134/1 X |
| 3,154,890 | 11/1964 | Lemelson | 15/321 X |
| 4,000,538 | 1/1977 | Tissier | 15/320 |

*Primary Examiner*—S. Leon Bashore

*Assistant Examiner*—Marc L. Caroff

*Attorney, Agent, or Firm*—Mallinckrodt & Mallinckrodt

[57] ABSTRACT

A cleaning head is adapted to rest on and be moved over the material to be cleaned. The cleaning head has a central chamber, open at its bottom, and at least one relatively narrow chamber, open at its bottom, peripherally surrounding the central chamber. Ultrasonic transducer means are provided in the central chamber and means are provided for supplying a cleaning solution to the central chamber and for maintaining the level of the solution in the chamber such that at least a portion of the transducer means is immersed in the solution so that vibrations of the transducer means are imparted to the solution. Means are provided for adjusting, i.e. controlling, the pressure of the cleaning solution in the central chamber and the pressure in the at least one peripheral chamber to substantially eliminate the flow of air into the solution in the central chamber and to prevent escape of substantial amounts of solution from the cleaning head.

13 Claims, 5 Drawing Figures

APPARATUS FOR ULTRASONIC CLEANING OF CARPET, UPHOLSTERY, AND SIMILAR MATERIALS

BACKGROUND OF THE INVENTION

1. Field

The invention is in the field of carpet or upholstery cleaning methods and apparatus which utilize ultrasonic energy to aid in the cleaning process.

2. State of the Art

Various attempts have been made to adapt the known benefits of cleaning a small item in a bath of solution which is vibrating at an ultrasonic frequency, to the cleaning of carpets and upholstery. The major problem in this regard is that the carpet or upholstery to be cleaned cannot be placed in a bath of solution. The bath of solution has to be maintained on the material to be cleaned and intimate contact between the solution and material being cleaned must be maintained. Some prior attempts have used air as a cleaning medium while others have attempted to use a cleaning solution foam. Air is a compressible fluid, however, so that the ultrasonic energy imparted to the air is quickly absorbed and disapated. Similarly, in a foam as in a solution with many air bubbles, the bubbles are compressible and quickly absorb the ultrasonic energy. Thus, most of the energy that should be used for cleaning does not reach and act on the surface to be cleaned.

The units that have used a solution as the cleaning medium have made no provision to minimize the amount of air that is in the solution or that comes into the solution from the material to be cleaned. Thus, air trapped about the fibers in the material to be cleaned may absorb the energy without much of it actually reaching the fibers. Further, the patents dealing with units using a solution all indicate that cavitation of the liquid takes place and is desirable. It has been found, however, that unless extremely high liquid pressures are used (higher than could be used in an open bottomed cleaning head), real cavitation does not take place in the liquid. The liquid inherently contains dissolved air which forms air bubbles, rather than the voids which occur during cavitation. These bubbles actually hinder the cleaning action of the solution since they absorb energy, as mentioned above.

A further problem is maintaining the solution on and above the material to be cleaned and moving such solution over the material without appreciable leakage of the solution.

3. Object

An object of the present invention is to maintain and move a quantity of ultrasonically vibrating cleaning solution over material to be cleaned while minimizing the generation of air bubbles in the cleaning solution and promoting removal of air from the material to be cleaned so that the vibrating solution penetrates about the fibers and exerts the maximum cleaning action on such fibers.

SUMMARY OF THE INVENTION

According to the invention, carpets, upholstery, and similar materials may be cleaned by holding a quantity of cleaning solution in contact with material to be cleaned and by imparting ultrasonic vibrations to the solution. The amount of air that can enter the solution from the material being cleaned as the solution is moved over the material, as well as the amount of solution lost, is reduced by providing at least one area peripherally of the solution and in communication with the material being cleaned and by adjusting the pressure of the solution in the quantity of solution and the pressure in the at least one peripheral area.

Apparatus according to the invention includes a cleaning head adapted to rest on and be moved over material to be cleaned. The head has a central chamber, open at its bottom to communicate with the material to be cleaned, and at least one relatively narrow chamber, open at its bottom, peripherally surrounding the central chamber. Transducer means adapted to produce ultrasonic vibrations are located in the central chamber and means are provided to supply a cleaning solution to the central chamber in quantity sufficient to maintain the solution level in the chamber, when the cleaning head rests on the material to be cleaned, such that at least the working portion of the transducer means is immersed in the solution, whereby, vibration of the transducer means causes vibration of the solution.

Means are provided for adjusting, i.e. controlling the pressure of the cleaning solution in the central chamber and the pressure in the at least one peripheral chamber to substantially eliminate the flow of air into the solution in the central chamber and to prevent substantial escape of solution from the cleaning head. The means preferably include means to create a partial vacuum in the central chamber above the cleaning solution. This reduces the static head of the solution at the point of contact of solution with material to be cleaned, thereby lessening the pressure which tends to cause the solution to escape about the walls of the central chamber.

The pressure adjustment in the peripheral chamber is preferably by means which creates a partial vacuum in the chamber. The partial vacuum in the chamber is preferably such that a very slight flow of solution from the central chamber to the peripheral chamber takes place, thereby substantially reducing the amount of air entering the solution in the central chamber. This also significantly limits the flow of solution from the central chamber. Flow of solution from the cleaning head is further lessened by reason of a small air flow from outside the peripheral chamber into the peripheral chamber. This air flow acts as a wall against solution flow.

In many cases it may be necessary to provide more than one peripheral chamber surrounding the central chamber. When this is done, it may be desirable to have two sets of such chambers, each set having one or more peripheral chambers. The set of chambers adjacent the central chamber will be provided with a partial vacuum such that a slight flow of solution will occur from the central chamber as mentioned above, and from peripheral chamber to peripheral chamber in the set. The use of multiple chambers further reduces the amount of air entering the central chamber. The second set of peripheral chambers surrounds the set which is adjacent to the central chamber. The pressure in the peripheral chambers of the second set are adjusted so that an air flow takes place from the outermost of such chambers progressively to the innermost and to the outermost of the first set of peripheral chambers. This creates a larger air wall to prevent loss of substantial amounts of solution from the cleaning head.

Means may be provided to recycle and filter cleaning solution and to deair the recycled solution before it is added to the central chamber. Means may also be provided to withdraw solution that may build up in the peripheral chambers so that it may be recycled to the central chamber.

THE DRAWINGS

The best mode presently contemplated of carrying out the invention is illustrated in the accompanying drawings in which:

FIG. 1 is a perspective view of the cleaning head of the invention;

FIG. 2, a bottom plan view of the cleaning head of FIG. 1;

FIG. 3, a longitudinal vertical section of the cleaning head taken on the line 3—3 in FIGS. 1 and 2, a portion of the transducer housing being broken away showing the transducer units;

FIG. 4, a transverse vertical section taken on the line 4—4 of FIG. 1 and 2, a portion of the fan chamber wall being broken away; and FIG. 5, a schematic representation of the arrangement of the cleaning head in a self-contained unit to be moved over carpet to be cleaned.

DETAILED DESCRIPTION OF THE ILLUSTRATED EMBODIMENT

Figure 1:
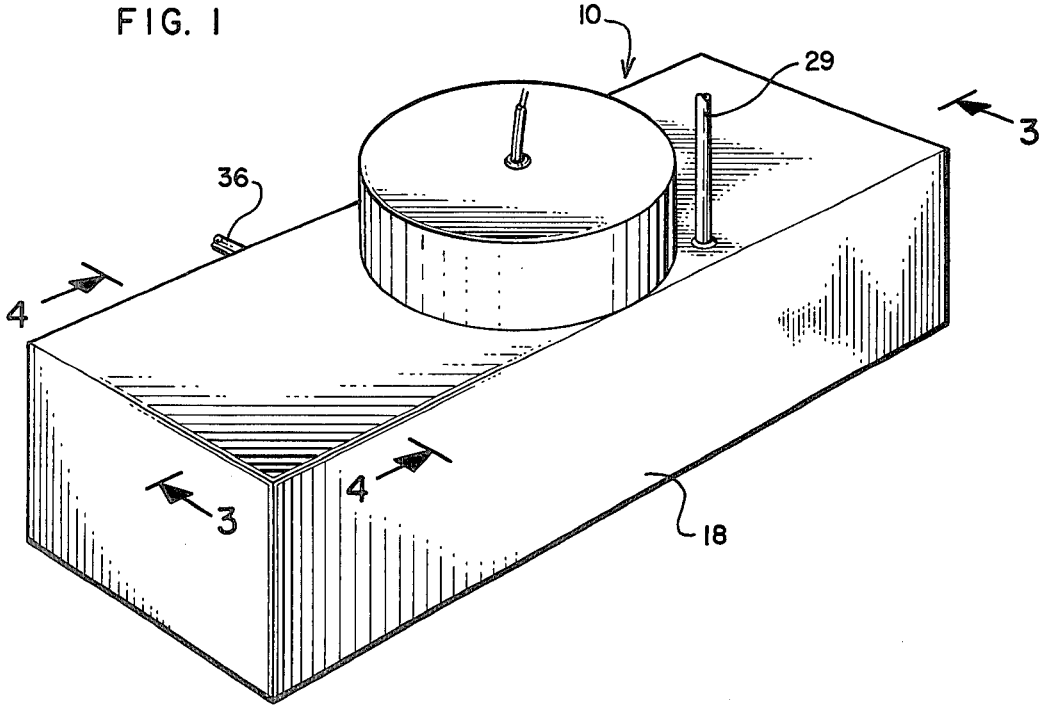
Figure 2:
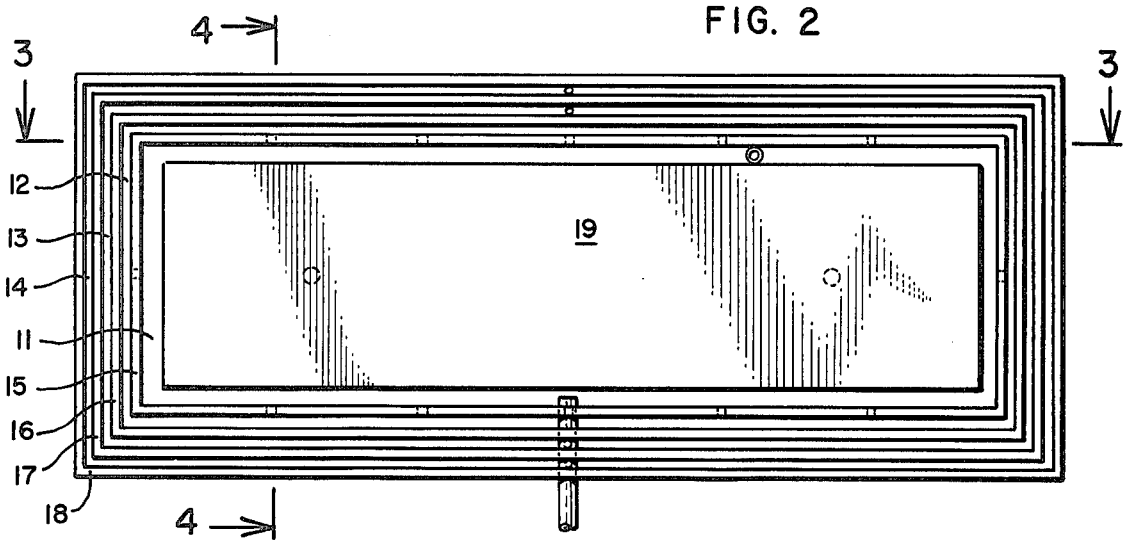
Figure 3:
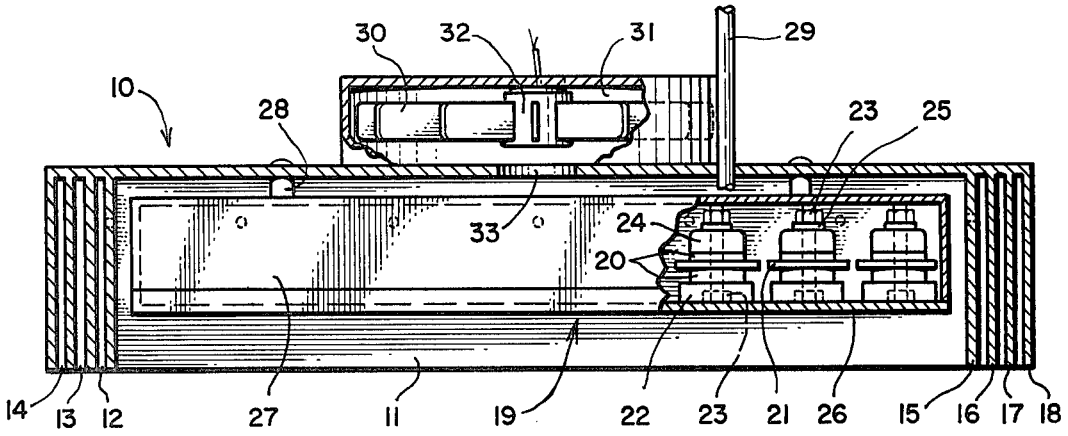

A cleaning head 10 has a central chamber 11 therein with relatively narrow peripheral chambers 12, 13, and 14 surrounding the central chamber. Walls 15, 16, 17 and 18 divide the various chambers and wall 18 defines the outer wall of the cleaning head.

The chambers are open at their bottoms and the cleaning head is adapted to rest on material to be cleaned. The material to be cleaned forms the bottom of each chamber.

An ultrasonic transducer means 19 is suspended in the central chamber. Any transducer means which vibrates and may be submerged in a fluid to impart vibration to the fluid, may be used. In the embodiment illustrated, a series of lead zirconate titanate transducers 20, designed to vibrate at a primary frequency of 40 kilohertz, are sandwiched together with a thin phosphor bronz sheet 21 between them which forms an electrode. The sandwiches are mounted in pairs on dural or steel bars 22 by bolts 23 which extend through bars 22, transducers 20, dural or steel pieces 24, and washer 25. The dural or steel pieces 24 provide additional mass to act against the transducers to ensure that the maximum amount of energy is transferred to bar 22. Suitable transducers are available from Edo-Western Corporation in Salt Lake City, Utah. The bars 22 are secured by suitable means, such as epoxy bonding, to the inside of bottom 26 of a stainless steel housing 27 which completely encloses the transducers and is mounted in the central chamber 11 by means of mounting studs 28. The entire bottom 26 of housing 27 vibrates when the transducers are energized. The normal energization signals are supplied between the electrode 21 and any other conductive portion of the assembly such as bars 22 or bolts 23. The primary frequency of vibration is the primary frequency of the transducers, here 40 kilohertz, with various resonances causing vibrations up to about 100 kilohertz. The frequency of vibration is not critical, however, and can vary widely.

Cleaning solution such as water, a water-soap solution, or other substantially non-compressible solution, is supplied to the central chamber through inlet pipe 29. The solution level is maintained so that the transducer means is at least partially submerged in the solution. In this way, the vibrations of the transducer are transferred to the cleaning solution and the cleaning solution vibrates similarly to the transducer. Pipe 29 preferably extends into the solution to minimize generation of air bubbles in the solution as additional solution is added to the chamber. Rather than all solution entering through a single pipe, means could be provided to more evenly spread the fluid over the area of the chamber.

The solution is held in the central chamber by wall 15 surrounding the central chamber and by the material to be cleaned which forms the bottom of the chamber. Some solution escapes, however, around the bottom of wall 15 where it rests on the material to be cleaned. To reduce the pressure on the solution tending to cause it to escape, a partial vacuum is provided above the solution in the central chamber. A partial vacuum is also provided in the peripheral chamber 12 surrounding the central chamber to pick up any solution that may escape under wall 15 and also to insure that any solution flow that does occur is from the central chamber to the peripheral chamber and that there is no substantial air flow into the central chamber.

The amount of partial vacuum in the central chamber is compared to that in the peripheral chamber may be balanced so that very little or no solution flows from the central chamber to the peripheral chamber, or so that there is a slight flow of solution to the peripheral chamber. In any case, the pressure on the peripheral chamber side of the bottom of wall 15 should not be greater than the pressure exerted by the solution at the central chamber side of the bottom of wall 15. This substantially eliminates any air flow that might otherwise occur into the central chamber and substantially removes the air from, and insures good solution contact with, the material over which the cleaning head is moved as it is being moved across such material. Reducing air flow into the cleaning solution in the central chamber is important in reducing the formation of bubbles in the solution that can absorb vibrational energy. In some instances, it may be necessary to provide more than one peripheral partial vacuum chamber to insure that only a minimum amount of air enters the solution in the central chamber.

If necessary, to further guard against substantial loss of cleaning solution as the cleaning head is moved over material to be cleaned, peripheral chambers 13 and 14 may be provided with a pressure greater than that in peripheral chamber 12 so that there is created a slight positive air flow progressively from chamber 14 to 13 to 12. This air flow provides a wall to prevent escape of cleaning solution.

Figure 4:
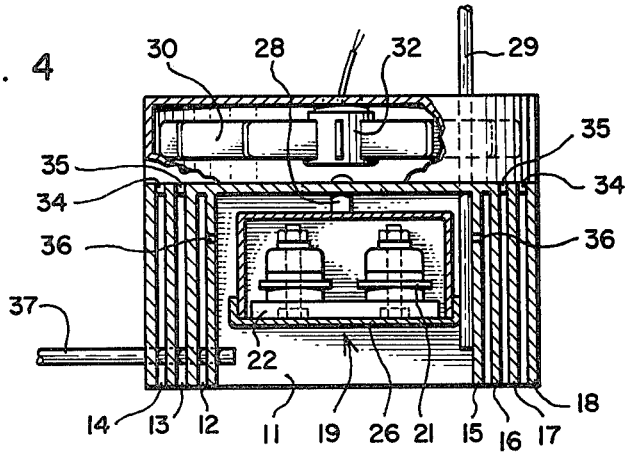

Although there are various ways of creating the partial vacuums and pressures for the central and peripheral chambers, the presently preferred method, because of its simplicity and compactness, is to provide a thin radial centrifical fan 30, or the like, positioned in a fan chamber 31 above the central chamber with the fan blades extending over the peripheral chambers as shown in FIG. 4. The motor for this type of fan is usually incorporated in the central shaft 32 of the fan. The central chamber 11 has an opening 33 at its top which communicates with the central portion of the fan chamber 31. As the fan 30 rotates, it forces any air about its central portion toward the outside of its blades, creating a partial vacuum about its center and a pressure about its outer periphery. The pressure increases from the center to the periphery of the fan. The outer peripheral chamber 14 of the cleaning head communicates, via holes 34, with the outer portion of the fan chamber 31. Peripheral chamber 13 communicates, via holes 35, with the fan chamber at a point somewhat inwardly of the outer periphery of fan 30, and inwardly from holes 34, so that the pressure in peripheral chamber 13 is less than in peripheral chamber 14.

The peripheral chamber 12 communicates, via holes 36, with the central chamber 11. Thus, a partial vacuum substantially equal to that in the central chamber appears in peripheral chamber 12. Considering the static head of the solution in the central chamber, the pressure exerted by the fluid at the bottom of wall 15 will be greater than the pressure at the bottom of chamber 12 so a desirable slight flow of fluid is established.

In operation, the cleaning solution stands on the material to be cleaned, surrounding and in intimate contact with the individual upstanding fibers. The vibration of the solution scrubs each individual fiber removing the dirt therefrom. It is preferred that the solution vibrate at more than one frequency because it has been found that better dirt removal results. It is thus desirable that the transducer means be designed to vibrate not only at a primary frequency but at harmonics thereof and to transmit all vibrations to the fluid.

The cleaning solution in the central chamber will normally become dirty as the cleaning operation continues. It is therefore desirable to continually remove solution from the central chamber and replace it with cleaned solution. Solution is removed through pipe 37. Again, as with the solution input, means could be provided to withdraw the solution from several points rather than a single point.

Figure 5:
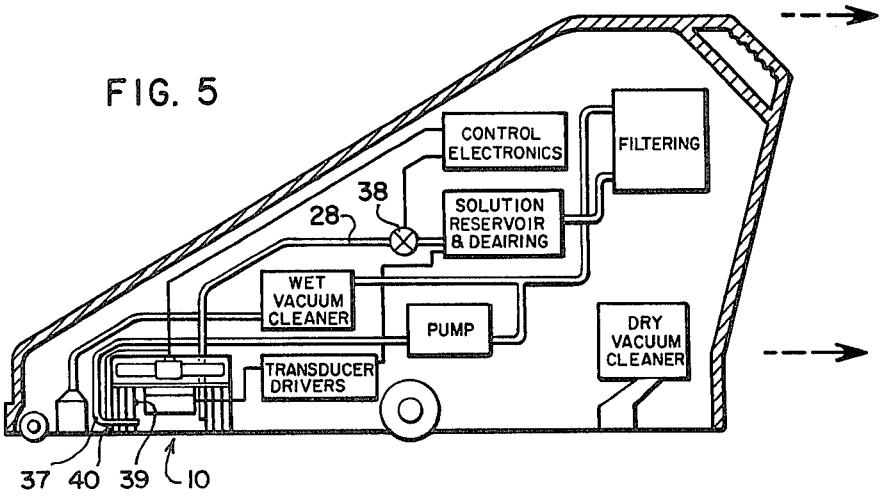

FIG. 5 shows in schematic representation the typical components for a complete carpet cleaning system based upon the ultrasonic cleaning head of the invention. All of the components of the system are preferably arranged in a single housing which is designed to be moved over a carpet to be cleaned. As shown, the housing is supported on wheels for easy movement, and is designed to be pulled across carpet, movement to the right in FIG. 5 being forward movement. Provision may be made to support the system on a cushion of air to provide additional ease of movement. If such is the case, provision must be made to insure that the cleaning head 10 remains in contact with the carpet being cleaned.

As the system moves across a carpet to be cleaned, loose dirt is removed by a conventional vacuum cleaner. The ultrasonic cleaning head 10 follows the conventional vacuum cleaner and operates as previously described. A conventional wet vacuum cleaner follows the cleaning head to remove any cleaning solution that may have escaped from the cleaning head and remains in the carpet.

Also included in the housing is a solution pump to withdraw solution from the central chamber through pipe 37 for cleaning and recycling. The solution withdrawn is pumped to a filtering unit where it is filtered to remove suspended dirt and then enters the solution reservoir. Any solution vacuumed up by the wet vacuum is also sent to the filtering unit where it is filtered and then flows to the solution reservoir.

Provision is preferably included for deairing the solution in the solution reservoir so that the solution being sent back to the cleaning head will be as free of dissolved air as possible. The deairing may be accomplished by providing ultrasonic transducers arranged to cause vibration of the solution in the solution reservoir. The transducers are energized for a short period and then stopped for a short period. The length of these periods is not critical. The transducers may conveniently be pulsed for periods of 1/60th of a second, on and off, causing the dissolved air to form into bubbles when on, and allowing the bubbles to rise to the surface when off. This has been found satisfactory to remove a substantial portion of the air from the cleaning solution. Transducers of the same frequency as used in the cleaning head may be used in the solution reservoir.

The electronics necessary to drive the transducers in the cleaning head and the deairing transducers in the solution reservoir are conventional and are included in the housing.

An electrically controlled valve 38 is positioned between the solution reservoir and the solution inlet 29 to the cleaning head to control the inflow of cleaning solution to the central chamber of the cleaning head. Control electronics are provided along with sensors, indicated generally at 39, in the cleaning head to monitor the level of cleaning solution in the central chamber. The control electronics control operation of the valve to insure a constant level of cleaning solution in the central chamber.

The control electronics also control the speed of fan 30 which controls the partial vacuum and pressures that are created in the various chambers of the cleaning head so that they may be maintained at the optimum values to prevent escape of the cleaning solution from the head. Sensors, indicated generally at 40, may be provided in the head to monitor solution loss from the head, or flow of air into the central chamber, and if desired, flow of either air or solution between various chambers. The information from these sensors is used in the control of the fan 30, or other vacuum or pressure sources.

It may be necessary to provide means for removing cleaning solution from one or more of the peripheral chambers as the level of such solution may build up in the chambers. This build up may occur particularly in the partial vacuum chamber immediately surrounding the central chamber. Such solution removal means may take the form of pipes similar to pipe 37, attached to remove solution from the chambers, or the source of partial vacuum in the chambers may be wet vacuums which can remove solution as it builds up. In all cases, the removed solution may be conveniently fed to the filtering unit for recycling.

In addition to using the cleaning head of the invention in a large carpet cleaning system as shown in FIG. 5, the cleaning head could also be made as a small hand held unit for use in cleaning upholstery or other similar materials, or for small areas of carpet.

The number and arrangement of peripheral chambers as well as the pressures in each to give optimal results in preventing substantial air flow into the cleaning solution in the central chamber and preventing substantial solution escape from the cleaning head will vary and will depend upon the type of material cleaned and the manner in which it is cleaned. It may also depend upon the particular cleaning solution used.

While the means for adjusting the pressure of the cleaning solution in the central chamber and the pressure in the peripheral chambers has been shown and described as means for creating a partial vacuum above the cleaning solution in the central chamber and for creating a partial vacuum in at least the peripheral chamber immediately adjacent to the central chamber, it should be realized that the same balancing of pressures may be obtained by different adjustment of pressures. For example, the solution in the central chamber may be at atmospheric pressure and be balanced by atmospheric pressure in the peripheral chamber immediately adjacent the central chamber. An air wall may then be created by greater than atmospheric pressure in an additional peripheral chamber surrounding the first.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. Apparatus for cleaning carpet, upholstery, and similar materials, comprising a cleaning head adapted to rest on and be moved over material to be cleaned and having a central chamber, open at its bottom, and at least one relatively narrow chamber, open at its bottom, peripherally surrounding the central chamber; transducer means mounted in the central chamber for vibrating cleaning solution at an ultrasonic frequency; means for supplying a cleaning solution to the central chamber in quantity sufficient to maintain a cleaning solution level in the chamber, when the cleaning head rests on the material to be cleaned, such that at least a portion of the transducer means is immersed in the cleaning solution, whereby vibration of the transducer means causes vibration of the solution; and means for controlling pressure in the central chamber above the cleaning solution thereby controlling pressure of the cleaning solution in the central chamber and for controlling pressure in the at least one relatively narrow peripheral chamber surrounding the central chamber, to substantially eliminate any flow of air into the solution in the central chamber and to prevent escape of substantial amounts of solution from the cleaning head.

2. Apparatus according to claim 1, wherein the means for controlling the pressure of the cleaning solution in the central chamber and the pressure in the at least one relatively narrow peripheral chamber substantially equalizes the two pressures.

3. Apparatus according to claim 1, wherein the means for controlling the pressure of the cleaning solution in the central chamber and the pressure in the at least one relatively narrow peripheral chamber causes the pressure in the at least one peripheral chamber to be less than the pressure of the solution at the bottom of the central chamber so that a slight flow of solution from the central chamber to the peripheral chamber is created.

4. Apparatus according to claim 1, wherein the means for controlling the pressure of the cleaning solution in the central chamber and the pressure in the at least one relatively narrow peripheral chamber creates a partial vacuum in the peripheral chamber and in the central chamber above the cleaning solution.

5. Apparatus according to claim 1, wherein the at least one relatively narrow peripheral chamber includes at least two sets of such peripheral chambers one set of chambers including at least one such chamber and said one set of chambers being located adjacent the central chamber, the other set of chambers including at least one such chamber and said other set of chambers being located peripherally of said one set of chambers; and the means for controlling the pressure of the cleaning solution in the central chamber and the pressure in the at least one relatively narrow peripheral chamber causes the pressure in said one set of pheripheral chambers adjacent the central chamber to be less than the pressure of the solution at the bottom of the central chamber so that a slight flow of solution from the central chamber to said one set of peripheral chambers is created, and causes the pressure in said other set of peripheral chambers to be greater than that in said one set of chambers so that a slight flow of air from said other set of chambers to said one set of chambers is created.

6. Apparatus according to claim 1, wherein there is provided means for continually recycling the cleaning solution from and to the central chamber.

7. Apparatus according to claim 6, wherein filter means are provided to filter the recycled solution.

8. Apparatus according to claim 7, wherein means are provided to deair the recycled solution before it is reintroduced into the central chamber of the cleaning head.

9. Apparatus according to claim 8, wherein the deairing means includes a solution reservoir; and deairing transducer means for intermittently causing ultrasonic vibrations of the solution in the reservoir, whereby dissolved air in the solution will form into bubbles during the periods the transducer is causing vibrations and the bubbles will rise during the periods when vibration is stopped.

10. Apparatus according to claim 9, wherein the deairing transducer means operates intermittently with equal on and off periods of 1/60 of a second.

11. Apparatus according to claim 1, wherein the transducer vibrates at a primary frequency of about 40,000 cycles per second.

12. Apparatus according to claim 11, wherein the transducer causes the cleaning solution to vibrate at the primary frequency of vibration and at various harmonics thereof.

13. Apparatus according to claim 1, wherein the transducer causes the cleaning solution to vibrate at the primary frequency of vibration of the transducer and at various harmonics thereof.

* * * * *